US005421724A

United States Patent [19]

Facco

[11] Patent Number: 5,421,724

[45] Date of Patent: Jun. 6, 1995

[54] ROLLS FOR HIGH TEMPERATURE ROLLER HEARTH FURNACES

[75] Inventor: Giuseppe Facco, Pittsburgh, Pa.

[73] Assignee: Italimpianti of America, Inc., Coraopolis, Pa.

[21] Appl. No.: 168,937

[22] Filed: Dec. 16, 1993

Related U.S. Application Data

[62] Division of Ser. No. 36,161, Mar. 24, 1993.

[51] Int. Cl.[6] ..... F27D 3/00

[52] U.S. Cl. ..... 432/236; 432/246; 138/147; 138/149

[58] Field of Search ..... 432/236, 246; 138/147, 138/149

[56] References Cited

U.S. PATENT DOCUMENTS

| | | | |
|---|---|---|---|
| Re. 15,011 | 12/1920 | Costello . | |
| 1,097,303 | 5/1914 | Costello . | |
| 1,737,117 | 11/1929 | Morton . | |
| 1,770,103 | 7/1930 | Fahrenwald . | |
| 1,834,304 | 12/1931 | Frank et al. . | |
| 1,844,231 | 2/1932 | Sipe et al. . | |
| 2,045,773 | 6/1936 | Havey | 263/6 |
| 2,056,510 | 10/1936 | Fallon | 263/6 |
| 3,051,460 | 8/1962 | Furczyk | 432/236 |
| 3,116,053 | 12/1963 | Ericsson | 432/236 |
| 3,870,100 | 3/1975 | Korting et al. | 432/236 |
| 3,965,974 | 6/1976 | Sernetz et al. | 432/246 |
| 4,049,372 | 9/1977 | Bloom | 432/246 |
| 4,426,953 | 1/1984 | Kromm, Jr. et al. | 432/75 |
| 4,427,187 | 1/1984 | Denis | 266/274 |
| 4,556,385 | 12/1985 | Denis | 432/122 |
| 4,578,011 | 3/1986 | Braud et al. | 414/152 |
| 4,582,483 | 4/1986 | Braud | 432/127 |
| 4,723,909 | 2/1988 | Rouvet | 432/122 |
| 4,832,154 | 5/1989 | Thoor | 185/27 |
| 5,042,452 | 8/1991 | Dubreuil et al. | 126/91 A |
| 5,075,953 | 12/1991 | Braud | 29/527.7 |
| 5,139,418 | 8/1992 | Rigan et al. | 432/122 |
| 5,230,618 | 7/1993 | Briemont et al. | 432/236 |

*Primary Examiner*—Henry C. Yuen
*Assistant Examiner*—Weilun Lo
*Attorney, Agent, or Firm*—Webb Ziesenheim and Bruening

[57] ABSTRACT

Roll designs for roller hearth furnaces operating at temperatures ranging from under 1200° C. to substantially higher are disclosed. A rotary mounted main roll body may be provided with a plurality of spaced tires for contacting and transporting a charge carried by the roll. An internal coolant circulation system is provided within the main roll body. Insulation may be provided around the main roll body.

5 Claims, 8 Drawing Sheets

ROLLS FOR HIGH TEMPERATURE ROLLER HEARTH FURNACES

This is a divisional of copending application(s) Ser. No. 08/036,161 filed on Mar. 24, 1993.

BACKGROUND OF THE INVENTION

1. Field of the Invention

This invention relates to roll designs, specifically to rolls for high temperature roller hearth furnaces.

2. Description of the Prior Art

In low temperature applications, less than 1100° C., non-water cooled alloy rolls are normally successfully utilized. At temperatures between 1100°-1200° C., rolls have been utilized for thin slabs where a water cooled shaft is equipped with a plurality of spaced tires welded to the shaft, wherein the roll is insulated with refractory clams.

The problems encountered with these prior art high temperature rolls are refractory failure, which generates bowing of the shaft and failure of the tires. Following tire failure, it is difficult to repair the roll. Removing and rewelding a tire are difficult without distorting the main shaft. In addition, these prior art rolls were not designed to handle heavy loads.

Additionally, at temperatures between 1100°-1200° C., non-water cooled rollers have been used in some occasions; however, drawbacks exist because of the limited strength of material at that temperature (roll failure could occur if the rolls are stopped from rotating). Also, at temperatures of about 1200° C., scale pickup starts becoming a problem.

For temperatures above 1200° C., roll designs encounter several additional problems. At these higher temperatures, the tires encounter greater steel scale pickup problems and the insulation life is further reduced. Additionally, the tires may be subject to cracks due to thermal stresses and fatigue.

The present invention has the purpose of overcoming the drawbacks of the prior art.

SUMMARY OF THE INVENTION

Several roll designs are included in this invention. The first design is for a roll having an application for temperatures up to 1200° C. or more which maintains good insulation surrounding the roll and provides an easily maintained roll. The roll includes a rotary mounted main roll body with internal coolant circulation. A plurality of tires is positioned at spaced locations along the main roll body for contacting and supporting a charge to be carried by the roll. A plurality of insulation shells surrounding the main roll body is provided with each insulation shell positioned adjacent one of the tires. Each of the insulation shells includes an inner metal shell, an intermediate layer of refractory insulation and an outer layer of hard material which is resistant to mechanical and thermal shock.

A second roll design of the present invention having applications for temperatures ranging between about 1200°-1250° C. has been designed. The roll includes a heat resistant main roll body with a hollow interior which rotates to transport the load. A cooling pipe is positioned in the center of the main roll body interior. A coolant supply is coupled to the cooling pipe so that the cooling pipe is maintained at a temperature much below the roll body temperature. A temperature gradient is generated between the furnace temperature and the cooling pipe temperature such that the roll body will work in a temperature lower than the furnace temperature. The cooling pipe may be nonrotatably mounted within the roll body. Furthermore, insulation may be provided to surround a portion of the supply pipe to minimize heat losses and cool only the part of the roll which is most highly stressed. The roll body may also be provided with a plurality of spaced tires which extend from the roll body.

A third roll design of the present invention is applicable to applications where furnace temperatures are substantially above 1200° C. and which is particularly suited to working with heavy loads and high speeds. The roll is specifically designed to eliminate the sticking of scale to the tires at high temperatures, to maintain adequate roll insulation at high temperatures and proper roll balance at high speeds and to minimize damage to the roll and insulation when impacted by heavy charges. The roll includes a rotary mounted main roll body provided with coolant circulation passages therein. A plurality of tires is positioned at spaced locations along the main roll body for contacting and supporting a charge to be carried by the roll. Each of the tires is fully cooled by the coolant fluid by adequate water passages in the tire itself which connect with water passages around the main roll body to allow coolant to flow through the main roll body and the tires. Stationary insulation is provided to surround the main roll body and includes a plurality of openings such that the tires extend through the openings above the insulation.

A fourth roll design of the present invention is applicable to working with relatively thin slabs, about two inches or less, and relatively low temperatures, about 1100°-1150° C., where scale sticking to the tires is known to occur in the prior art. This scale sticking may damage the slab bottom surface. The fourth roll design includes a rotary mounted main roll body with coolant circulation passages therein. A plurality of tires is positioned at spaced locations along the main roll body. Each of the tires includes coolant passages in the tire itself which connect with the coolant circulation passages in the main roll body. Insulation is positioned between adjacent tires and includes temperature resistant anchors welded to an outer layer of the main roll body to secure the insulation in place.

Other objects and advantages of the present invention will become apparent in the description of the preferred embodiments in connection with the attached figures.

DESCRIPTION OF THE PREFERRED EMBODIMENTS

Figure 1:
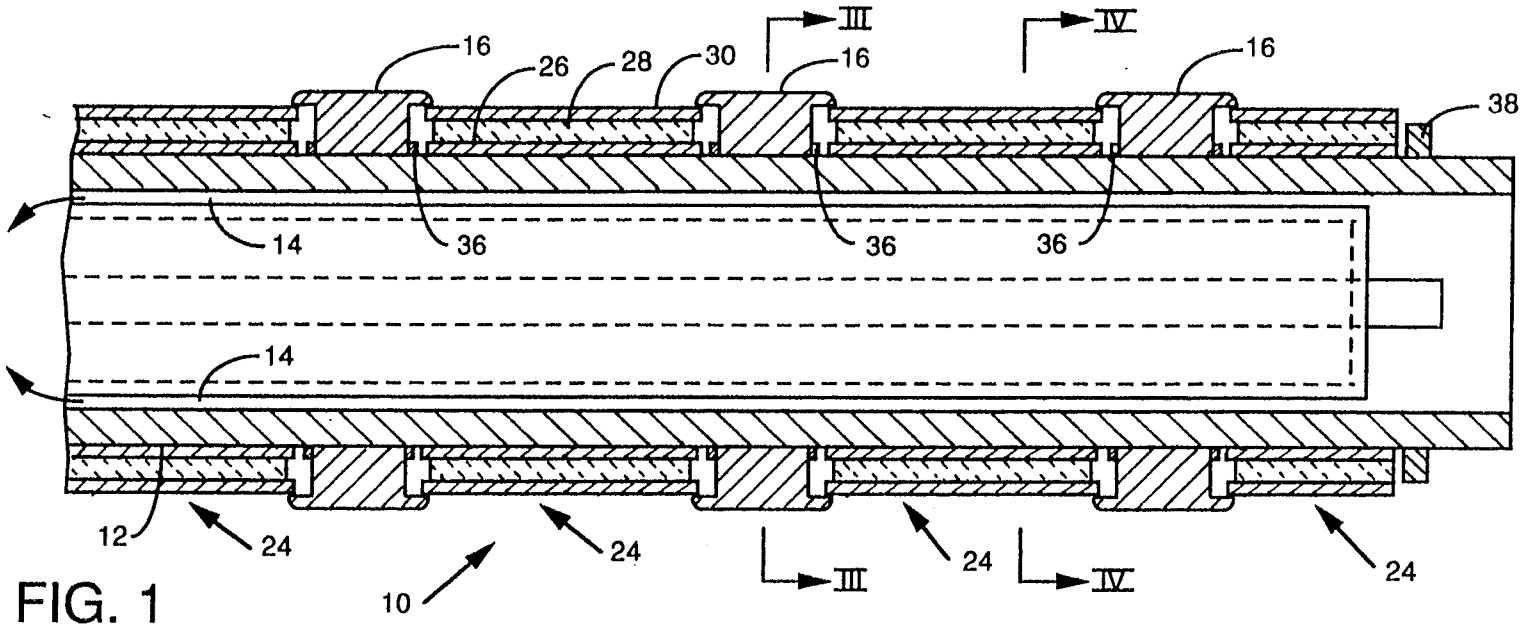
FIG. 1 is a sectional view of a portion of a roll of a first embodiment of the present invention.

The roll 10 shown in FIGS. 1–4 includes a rotatably mounted main roll body 12 which is provided with internally cooled circulation through gaps or channels 14 provided in the main roll body 12 interior. The main roll body 12 is generally made out of carbon steel or a low alloy steel which has good thermal conductivity characteristics. Water may be used as a coolant to keep the main roll body 12 at a lower temperature and maintain the strength and shape of the main roll body 12 during operation.

A plurality of tires 16 is provided at spaced locations along the main roll body 12 and is adapted for contacting and supporting a charge to be carried by the roll 10. The tires 16 may be preferably made of a high temperature alloy resistant to oxidation at high furnace temperatures, as well as resistant to "scale attack" and "sticking". The tires 16 may be of different heights and may have serrations 18, shown in FIG. 3, on either the inner or outer diameters (or both) to minimize the thermal stresses within the tires 16.

Figure 3:
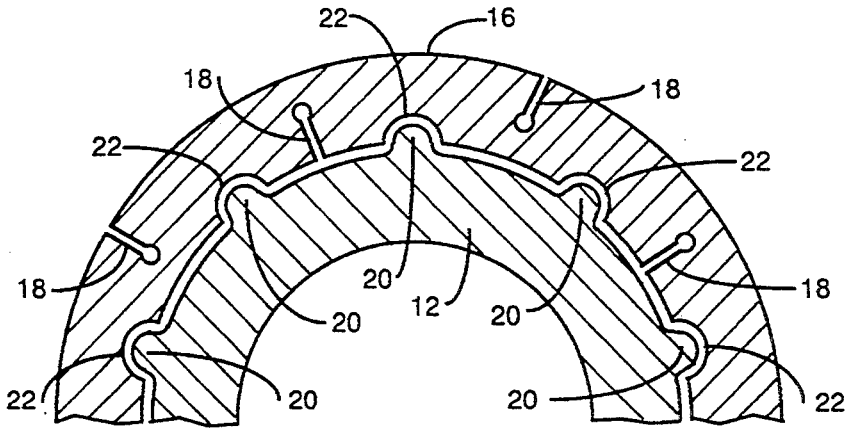
FIG. 3 is a cross-sectional view along lines III—III of the roll of FIG. 1 showing the interconnection between the main roll body and the tires.

The main roll body 12 includes a plurality of keys 20, shown in FIG. 3, which engage corresponding key cuts 22 in the tires 16. This will lock the tire 16 to the main roll body 12 and force the tire 16 to rotate with the main roll body 12. The tires 16 could freely roll over the main roll body 12 by eliminating the key 20 and key cut 22 configuration.

Insulation 24 is installed in the spaces adjacent the tires 16. This insulation 24 is made of a series of shells 26, 28 and 30 which surround the main roll body 12. The insulation includes an inner shell 26 of metal which is formed as either a solid or mesh-type metal, preferably with heat resistant capability. On the inner shell 26, a refractory shell, or insulation layer, 28 is inserted. The refractory shell 28 may be made, for example, by one or more of the following: fiber insulation; a vacuum-formed, ring-shaped fiber either formed on or anchored to the top of the inner metal shell 26; or a ring of castable cast anchored to the top of the inner shell 26. Attached to the outside of the refractory shell 28 is a shell 30 of hard material resistant to mechanical and thermal shock. This shell 30 can either be made of a special ceramic material or a metal capable of withstanding furnace environment without being rapidly oxidized.

Figure 4:
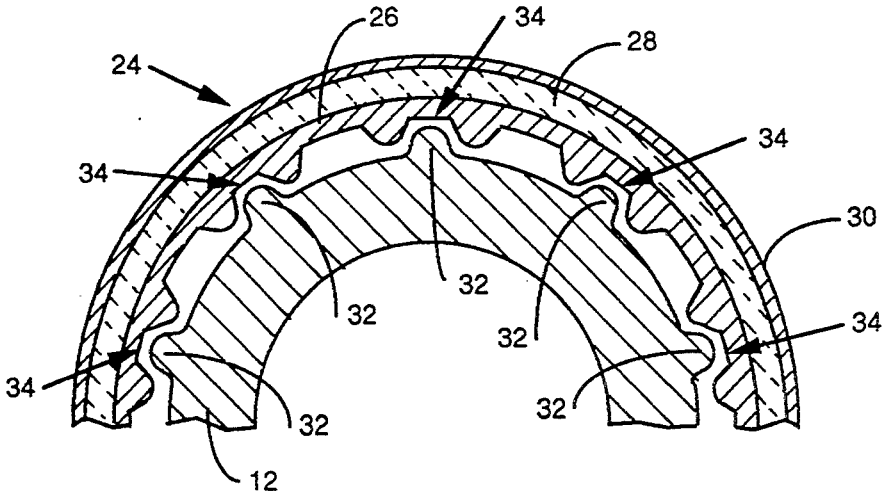
FIG. 4 is a cross-sectional view along lines IV—IV of the roll of FIG. 1 showing the interconnection between the main roll body and the insulation.

Keys 32, shown in FIG. 4, are provided on the main roll body 12 which engage key cuts 34 in the insulation to force the insulation 24 to rotate with the main roll body 12. This mechanical locking system is similar to the connection between the tires 16 and the main roll body 12. The insulation 24 could freely rotate on the main roll body 12 by eliminating the key 32 and key cut 34 arrangement.

Figure 2A:
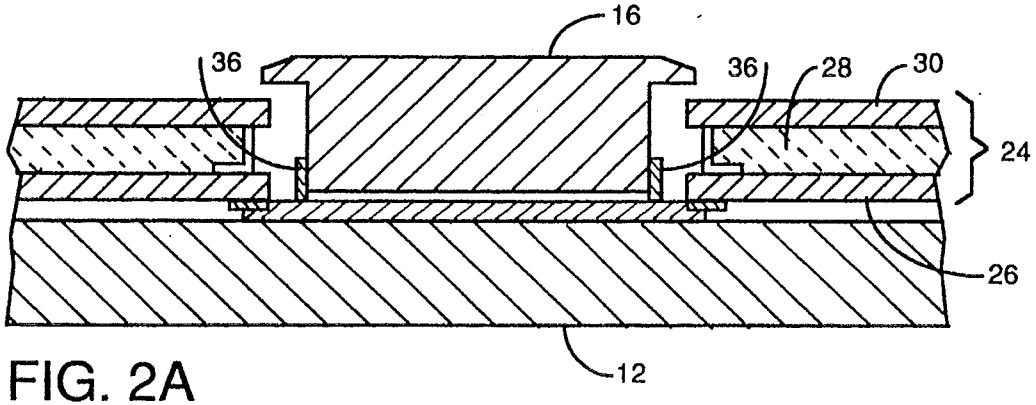
FIG. 2A is an enlarged sectional view of a portion of the roll of FIG. 1.

The position of the tires 16 and insulation 24 may be positively located by the inclusion of spacers 36, shown in FIGS. 1 and 2A, located on the main roll body 12. The inner shell 26 of the insulation 24 may also be utilized as a spacer element to adequately position the tires 16 on the main roll body 12. Alternatively, the location of the tires can be secured by spacers 36, or locating rings, to be discussed hereinafter.

At the two extreme ends of the roll 10, in an area normally protected from the furnace heat, locking blocks 38 are provided such that the series of tires 16 and insulation 24 may be maintained in the proper orientation on the main roll body 12. Where the main roll body 12 length is excessive or where the possibility of axial loads exist, the tires 16 can be locked into place by either welding the spacers 36 or other small blocks in position.

The insulation 24 of the present invention may be provided as two half shells to provide for easy replacement of the insulation 24 on the roll 10 without total disassembly. This split arrangement is preferred for where the tires 16 are held in place by welded spacers 36 or blocks.

The roll design of the present invention provides the advantage of utilizing material with great insulating properties such as, for example, ceramic fiber. With the present design, the insulation assembly 24 will deteriorate in a gradual manner that can be easily predicted over time allowing for preventive maintenance. The insulation 24 of roll 10 is an improvement over the conventional insulation which often fails in a nonsymmetrical manner leaving one side of the roll exposed to direct heat causing roll bowing. The present design reduces and practically eliminates this possibility since even if part of the insulation 24, in particular the outside portion of the insulation 24, is lost, the remaining heat resistant inner metal shell 26 is left to protect the main roll body 12 from direct radiation. This inner metal shell will significantly reduce the thermal stresses which would occur upon a directly exposed liquid cooled roll body.

Figure 5:
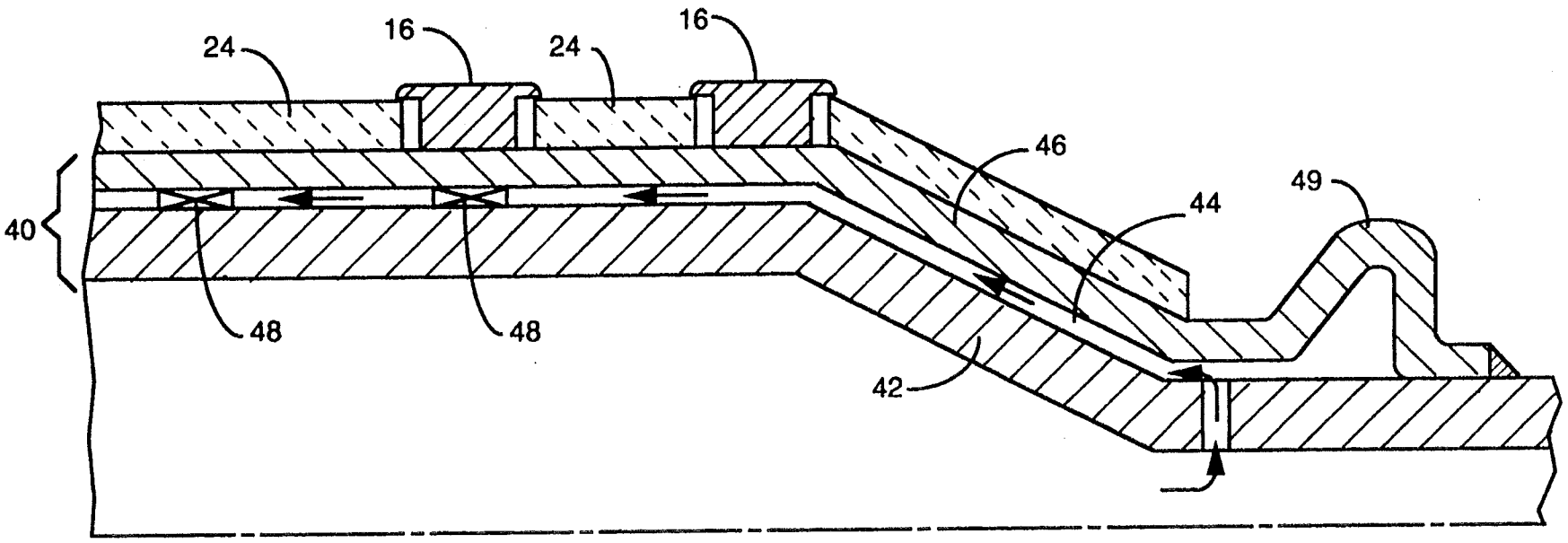
FIG. 5 is a sectional view of a modified roll design of the first embodiment of the present invention.

FIG. 5 illustrates a modification of the roll design of the first embodiment. In heavy applications the roll body needs to be thick due to strength requirements. However, when the main roll body is too thick, the heat gradient within the metal will generate excessive stresses which can lead to early failure. The present invention addresses this situation by providing a main roll body 40 with a double wall construction where an internal roll body 42 is provided which is separated by a gap 44 from an external roll body 46. The gap 44 allows for circulating cooling fluid, such as water, to flow through the main roll body 40. The internal roll body 42 is provided with a "thick and strong" construction to allow for sufficient strength in the main roll body 40, whereas the external roll body 46 is provided with a reduced thickness to avoid internal stresses. The external roll body 46, therefore, has a thickness less than the thickness of the internal roll body 42. Connectors 48 and end attachment 49 are provided to connect the internal roll body 42 with the external roll body 46 to provide a solid main roll body 40. The connectors 48 and end attachment 49 allow for differential thermal expansion between the internal and external roll bodies 42, 46 without generating unwanted secondary stresses. The connectors 48 also maintain the gap 44 for coolant circulation between the internal and external roll bodies 42, 46.

Figure 2B:
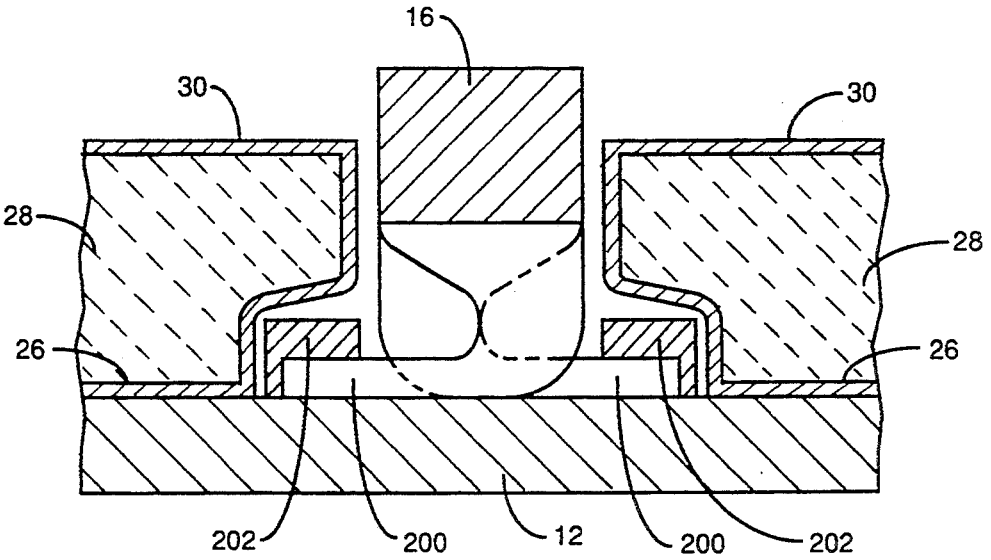
FIG. 2B is an enlarged sectional view of a portion of a modified roll.

FIG. 2B represents an alternative design of the tire 16 where tire 16 is supported on the main roll body 12 by a set of bent legs 200 distributed along the circumference of the tire 16, alternately on each side of the tire 16. The bent legs 200 are connected to the tire 16 at their extremity by rings 202.

The rings 202 are protected from the heat by the shells 28, 30. Therefore, the temperature of the rings 202 under normal operating conditions is much lower than the temperature of the tire 16. Consequently, the thermal expansion of the rings 202 is minimal.

Bent legs 200 are sufficiently flexible to allow tire 16 to expand and maintain connection with rings 202, which remain relatively cold, without inducing excessive stresses in the tire 16. This design has advantages in applications with higher speed of the rolls because of a lesser gap being generated between tire 16 and main roll body 12 due to thermal expansion. All other features relevant to the design shown in FIG. 2B remain unchanged. Additionally, the design in FIG. 2B can be utilized on rolls with other types of insulation or on rolls without insulation.

Figure 6:
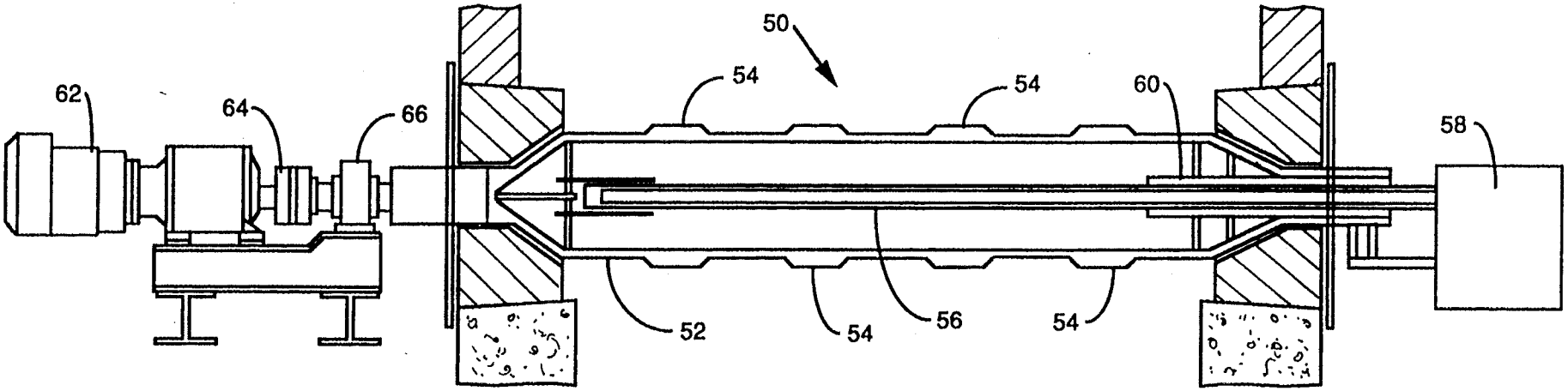
FIG. 6 is a sectional view of a roll of a second embodiment of the present invention.

FIG. 6 illustrates a "hot" roll 50 having an application for nigher temperatures as high as 1200° C. and slightly above. A rotary mounted heat resistant main roll body 52 is provided with adequate wall thickness to carry the required load at the desired operating temperatures. The main roll body 52 may be provided with a plurality of spaced tires 54 which extend from the surface of the main roll body 52. The spaced tires 54 are provided to support and carry a charge which is being transported by the roll 50. It is also possible that the main roll body 52 can be formed completely cylindrical.

The tires 54 may be made of a material different than the material used for the main roll body 52 and may be made separable from the main roll body 52. Such tires 54 can be locked on the main roll body 52 by welding or keying on the side of tire 54, such as described herein. Additionally, the tires 54 could be formed as a weld deposit or as a welded ring of adequate material. The tires 54 assist the tracking of the product within the furnace and reduce contact surfaces between the product and the roll 50. The portion of the roll 50 touching the product may be made of a material particularly suited for the purpose, such as a material having a greater resistance to scale attachment. The main roll body 52 can be made of a material which is best suited from a technical and economical point of view.

Figure 7A:
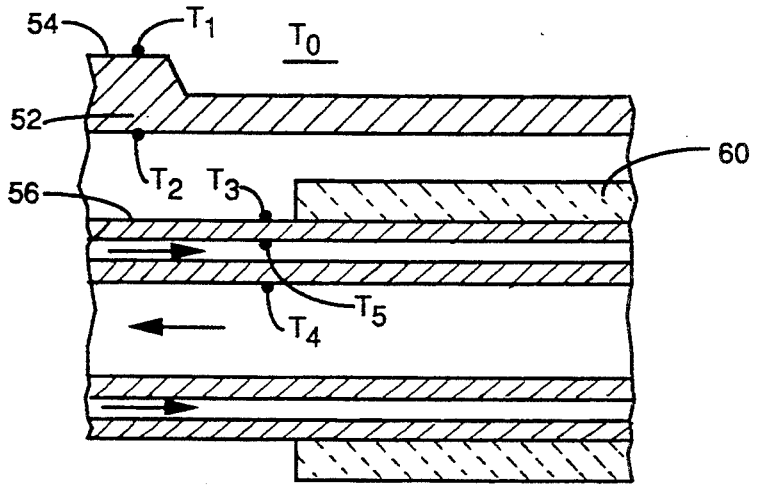
FIG. 7A is an enlarged sectional view of a portion of the roll of FIG. 6.

Inside the rotatably supported main roll body 52 is a stationary coolant pipe 56. The coolant pipe 56 supplies water to the interior of the main roll body 52 during use. The coolant pipe 56 is connected to an adequate coolant supply 58 to be fed through the coolant pipe 56. Water is an effective coolant. In certain applications, air may be utilized as a coolant. Other coolants are also possible. The coolant which flows through the coolant pipe 56 acts as a heat sink to extract heat from the main roll body 52 which is being heated in the furnace environment. During operation, a temperature gradient is formed from the furnace temperature T0 to the coolant temperature T5, as shown in FIG. 7A, wherein T0 is greater than T1 which is greater than T2 which is greater than T3 which is greater than T4 which is greater than T5. The main roll body 52 works at a temperature between T1 and T2, both of which are lower than the furnace temperature T0.

The average roll 50 temperature is greatly affected by the size of the coolant pipe 56 inside. Consequently, by adequately sizing the pipe 56, the desired working temperature of the roll 50 may be achieved.

Figure 8:
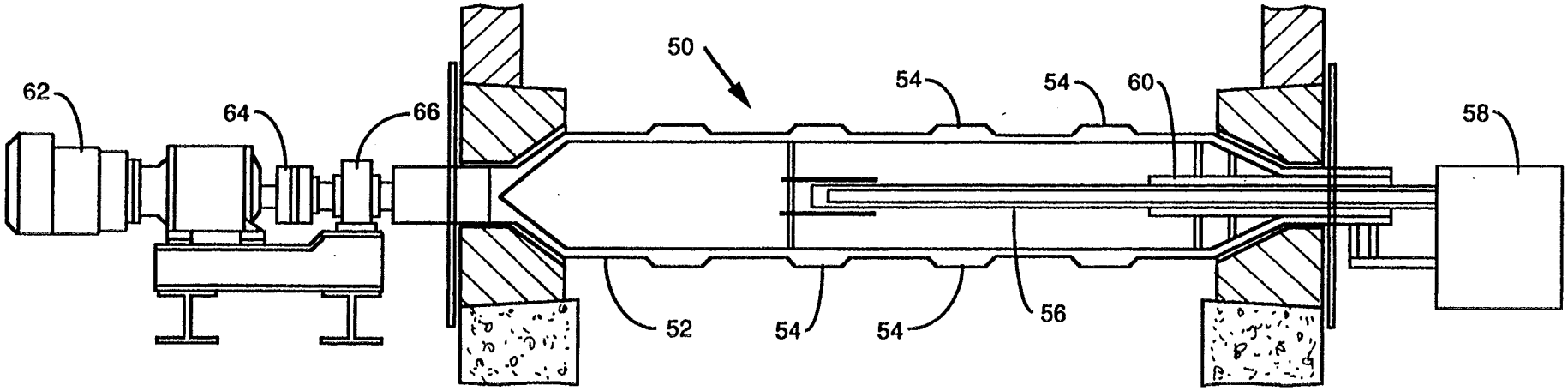
FIG. 8 is a sectional view of a further modified roll of the second embodiment of the present invention.

The heating process becomes less efficient as more heat is drained from the roll 50. Consequently, it is most important to lower the working temperature of the portion of the roll 50 which has higher stresses. In general, the most highly stressed area is in the center of the roll 50. Adequate insulation material 60 is provided on a portion of the coolant pipe 56 which faces the part of the main roll body 52 which does not need to be cooled. The coolant pipe 56 is not insulated at the central portion of the roll. The coolant pipe 56 may be made shorter, as shown in FIG. 8, such that it extends only to the portion of the main roll body 52 which is to be cooled. The insulation 60 is provided on the portion of the coolant pipe 56 adjacent the main roll body 52 which is not intended to be cooled.

Figure 9:
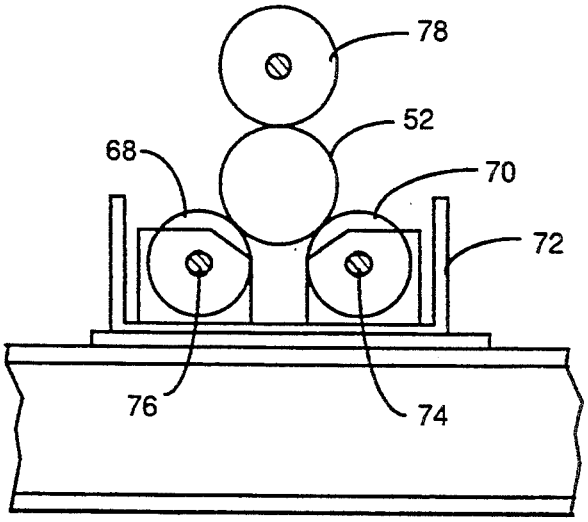
FIG. 9 is a view partially in section of an alternative support structure for one end of the roll of FIG. 6.

FIGS. 6 and 8 show the roll 50 driven by a motor/-gear system 62 coupled with a coupling 64 to the main roll body 52 with the main roll body 52 being supported on one side with a conventional bearing arrangement 66. On the other side of the main roll body 52, where the coolant pipe 56 is inserted, the size of the roll neck may be substantially larger due to the size of the coolant pipe 56. If this is the case, the conventional bearing arrangement 66 may be substituted with two small rolls 68, 70 mounted in a common support structure 72 on shafts 74, 76, as shown in FIG. 9. A third roll 78 may be added on the top of the roll neck to prevent possible uplifts of the roll 50.

Figure 7B:
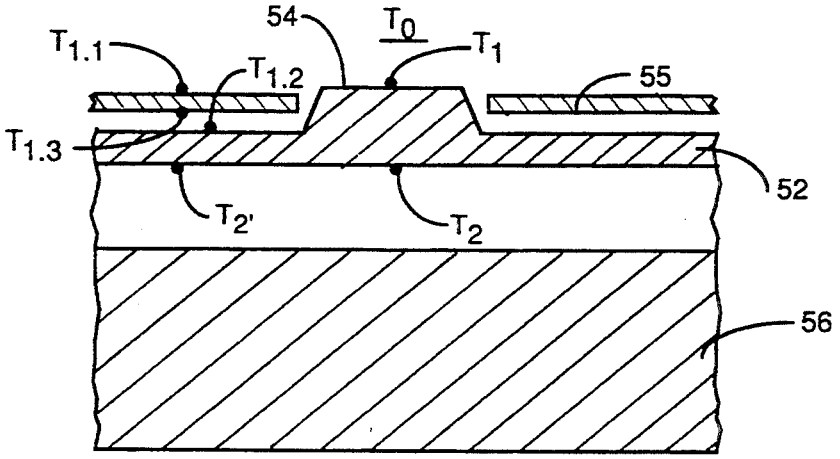
FIG. 7B is an enlarged sectional view of a portion of a modified roll of the second embodiment of the present invention.

FIG. 7B represents a variation to the design where, in between tires 54, a metal shield 55 made of heat resistant material is located over the main roll body 52. The shield 55 acts as a heat barrier, thus generating a situation where the tires 54 are the coldest areas of the exposed roll (this also helps to decrease scale sticking) while the exposed shield 55 between rings has a temperature $T_{1.1}$, $T_{1.2}$, higher than $T_1$ thus decreasing the heat losses of the roll. At the same time, the temperatures $T_{1.3}$ and $T_{2.1}$ are lower, respectively, than $T_1$ and $T_2$. Therefore the roll body is stronger in the portion where its section is smaller. This design minimizes heat losses of the rolls while maintaining fairly cold tires and minimizes the thickness of the main roll body 52.

Figure 10:
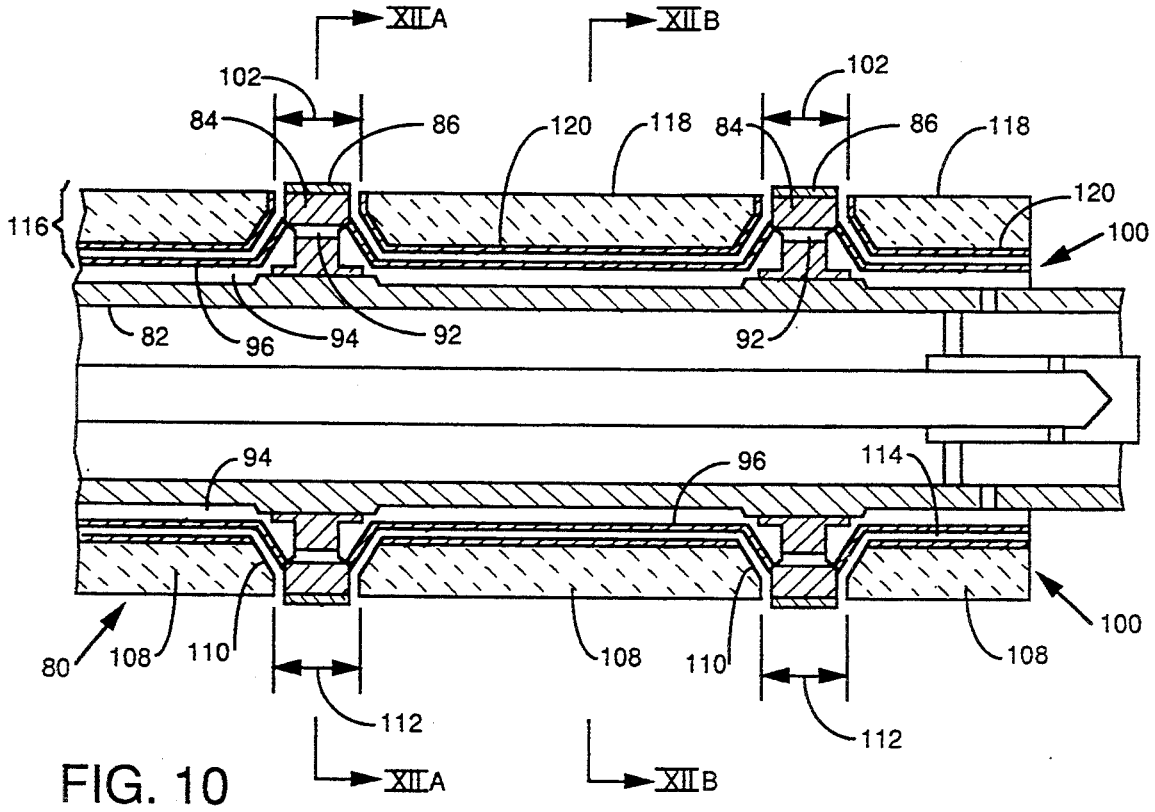
FIG. 10 is a sectional view of a portion of a roll of a third embodiment of the present invention.
Figure 11:
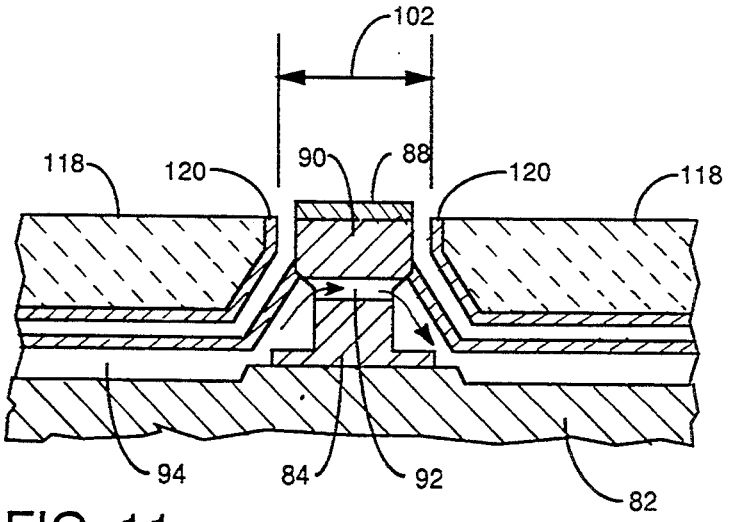
FIG. 11 is an enlarged sectional view of the roll of FIG. 10 showing a modified tire.

FIG. 10 illustrates a roll 80 which is particularly designed for applications where the furnace temperature is substantially above 1200° C. and which is particularly well-suited to work with heavy loads at high speeds. The roll 80 includes a main roll body 82 which is rotatably supported. The main roll body 82 may be made of carbon steel of sufficient diameter and thickness to obtain the required strength for the intended purpose. A plurality of tires 84 is positioned at spaced locations on the main roll body 82. The tires 84 are made of carbon steel or a low alloy steel. The tires 84 act as a main support for the load being carried. A top surface 86 of the tires may be coated with a metal deposit of a hard, heat resistant steel to improve resistance to oxidation, wear and deformation under heavy load. Alternatively, as shown in FIG. 11, a protection ring 88, either continuous or segmented, may be attached to an inner ring 90 to decrease the heat losses in the tire 84, as well as to provide a replaceable wear surface. The tires 84 are provided with a plurality of tire passages 92 extending therethrough which cooperate with circulation passages 94 provided in the main roll body 82. This cooperation allows the circulation of cooling fluid through the main roll body 82 and through the tires 84. Each tire passage 92 is provided near the top portion of the tire 84 such that the tire 84 is cooled in areas very close to the outside diameter of the tire 84.

An outer shell 96 of relatively thin steel, preferably carbon steel, surrounds the main roll body 82 in positions between the tires 84 to form the passages within the main roll body 82. The outer shell 96 is welded to the tires 84 at a position above the location of the tire passages 92 within the tires 84. Between the tires 84, the outer shell 96 is located relatively close to the main roll body 82. The outer shell 96 generates a gap around the main roll body 82 forming the circulation passages 94 within the main roll body 82 such that the cooling fluid may be circulated through the main roll body 82 and through the tire passages 92 in the tires 84. This coolant circulation system thereby also covers the tires 84 such that they may be kept extremely cold.

This particular design allows the tires 84 to protrude from the main roll body 82 to the extent that is required while maintaining cooling of the tires 84 such that scale sticking can be avoided. With greater tire height, a thicker insulation layer may be provided between the tires, decreasing heat losses. Appropriate design of the tires 84 is also utilized to avoid undesirable effects due to differential thermal expansion between the main roll body 82 and the tires 84.

Figure 13:
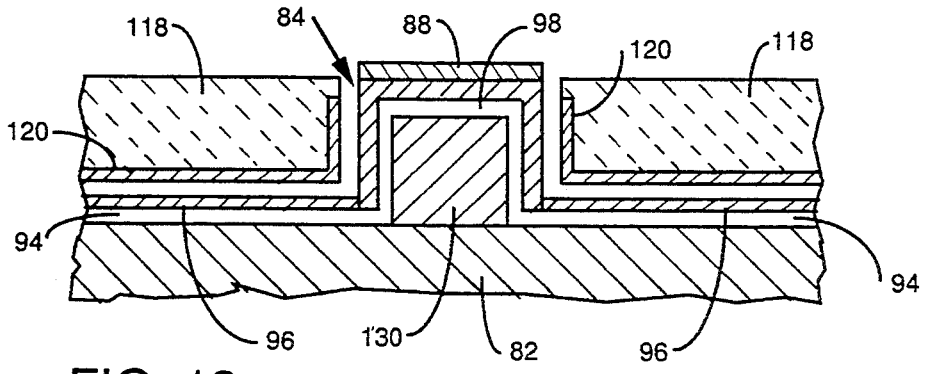
FIG. 13 is an enlarged sectional view of the roll of FIG. 10 showing a further modified tire.

FIG. 13 represents a variation in design where tire 84 has a channel-shaped section and, at the base where it supports on the main roll body 82, a set of perimeter passages 98 is provided in the tire 84 to collaborate with the circulation passages 94 to allow the flow of water to pass through the tire 84. Inside the tire 84, a ring-shaped structure 130 is located to generate the perimeter passages 98 between the ring-shaped structure 130 and the extremities of the tire 84 to force the water to pass around the inner perimeter of the tire 84 to assure the proper cooling of the tire 84.

Figure 12A:
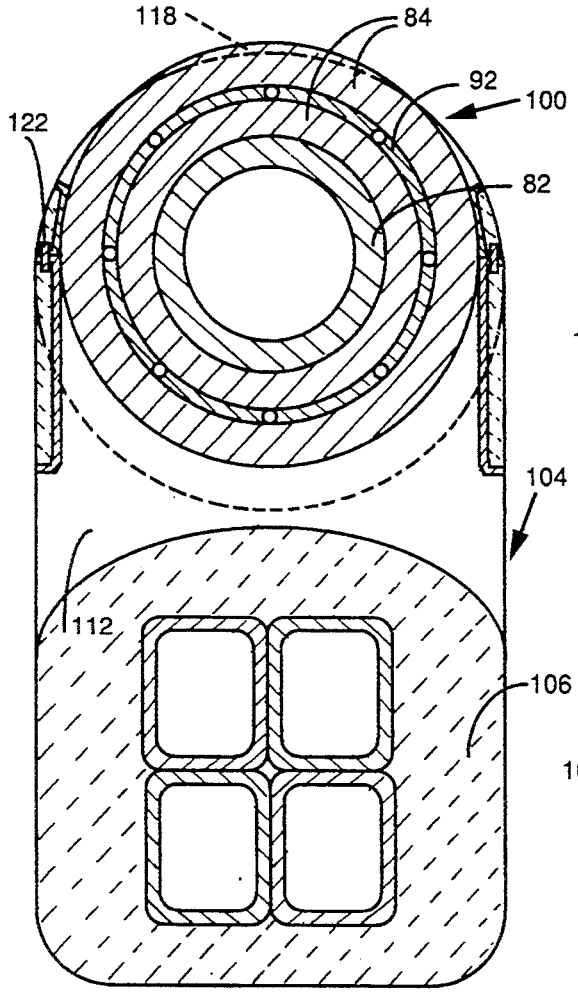
FIG. 12A is a sectional view along lines XIIA—XIIA of the roll of FIG. 10 and extended to show the base of the stationary insulation.
Figure 12B:
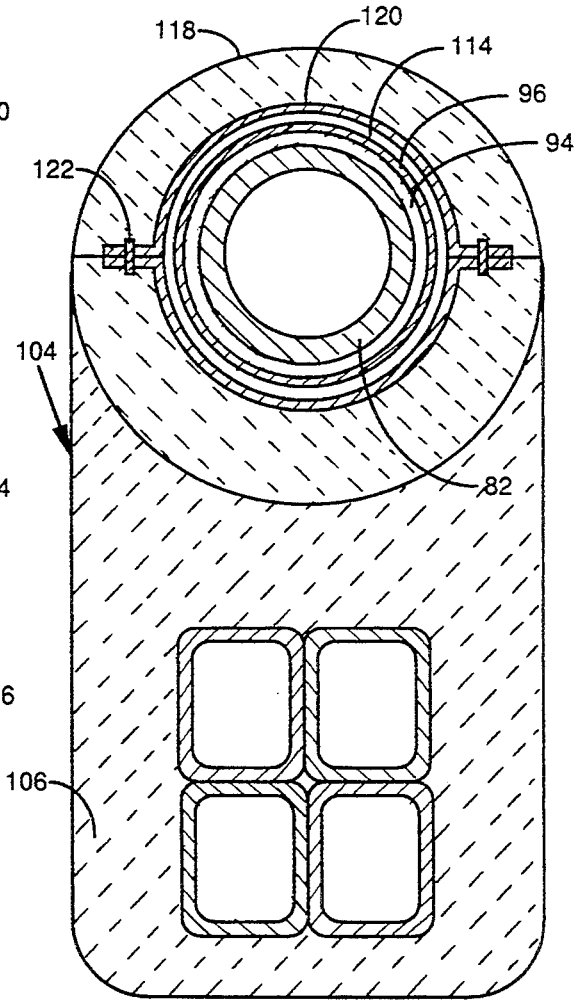
FIG. 12B is a sectional view along lines XIIB—XIIB of the roll of FIG. 10 and extended to show the base of the stationary insulation.

Stationary roll insulation 100 is provided to surround the main roll body 82 and is provided with a plurality of openings 102 such that the tires 84 may extend through the openings 102 above the insulation 100. The insulation 100 is made in a split design comprising two parts, as shown in FIGS. 12A and 12B. The bottom portion 104 includes an insulating block 106 which is installed underneath the roll and may be provided with a water cooling system. The base may be attached to the furnace or be removable with the roll. The bottom portion 104 includes a hollow shell 108 which surrounds approximately the bottom circumferential half of the main roll body 82. The shell 108 is provided with grooves 110, shown in FIG. 10, which accommodate the lower portion of the tires 84. Openings 112 within the grooves 110 allow for easy discharge of scale which may drop from the charge. When the main roll body 82 is inserted within the insulation 100, a gap 114 remains between the insulation 100 and the main roll body 82 to avoid roll body vibrations generated by the load movement being transmitted to the insulation 100. The insulation 100 in general can be fragile and subject to cracking if such vibrations are transmitted.

A top portion 116 of the insulation 100 includes a plurality of refractory tiles 118 adjacent the tires 84. The spaces between adjacent tiles 118 form the openings 102 through which the tires 84 extend. The tiles 118 surround the upper circumferential half of the main roll body 82 and leave the gap 114 between the insulation 100 and the main roll body 82 to prevent vibrations from being transferred to the tiles 118. The top of the tiles 118 is positioned below the top of the tires 84 so that the insulation 100 is not hit by the charge, even if there are defects in the charge surface. The tiles 118 may also have an inner metal shell 120 or reinforcement to provide for better durability.

The surface of the insulation 100 which faces the main roll body 82 can be made of a refractory material, preferably hard, to be resistant to scale impact. A metal shell 120 can be used as a support for refractory. Metal shell 120 is generally made of resistant material to extend the working life and also in case the refractory material is damaged.

Locking pins 122 can secure the tiles 118 to the bottom portion 104 to lock the insulation 100 in place.

One advantage of the present insulation system is that the main roll body 82 and the insulation 100 are completely independent such that roll vibrations are not transmitted to the insulation 100. Furthermore, the insulation 100 may be utilized with a variety of other roll bodies. The present invention also allows for the use of conventional refractories and techniques which are not subject to deterioration at high temperatures.

Figure 14:
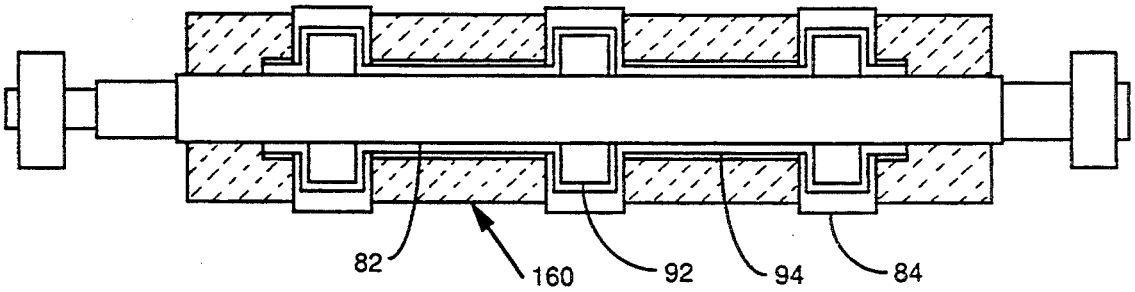
FIG. 14 is a sectional view of a roll of a fourth embodiment of the present invention.
Figure 15:
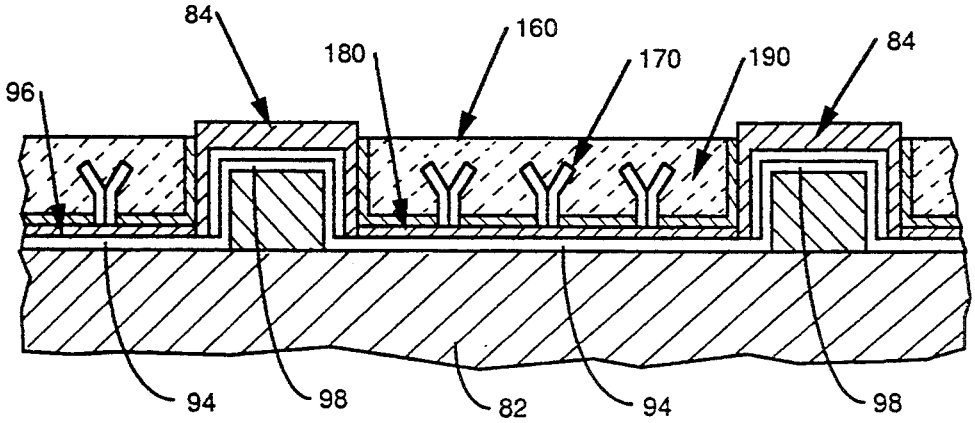
FIG. 15 is an enlarged sectional view of a portion of the roll in FIG. 14.

FIGS. 14 and 15 show a roll 150 applicable for working with relatively thin slabs, about two inches to three inches, or with relatively slow speed. The roll 150 includes a main roll body 82 and tire 84 construction the same as described in connection with FIG. 13 or FIG. 11 above. The roll 150 includes tires 84 which are directly cooled via passages 92 and 94 to overcome the scale sticking problem encountered in the prior art designs. Due to the moderate load on the roll 150 and the relatively slow speed presented by the intended working conditions of the roll 150, insulation 160 can be directly installed on the roll. The insulation 160 may include a soft insulation layer 180 and a hard refractory insulation 190. The insulation 160 is anchored to the main roll body 82 by temperature resistant anchors 170 incorporated into the insulation 160 which are welded to the metal shell 96 of the main roll body 82. Different types of insulation may be utilized such as the insulation described in connection with FIGS. 2A and 2B above.

From the foregoing, it will be apparent that modifications may be made to the disclosed devices without departing from the spirit and scope of the present invention. Accordingly, the scope of the present invention is only to be limited as necessitated by the accompanying claims.

I claim:

1. A roll for a high temperature roller hearth furnace, said roll comprising:

a) a heat resistant roll body having a hollow interior, said roll body being provided with a plurality of spaced tires extending from said roll body wherein said spaced tires support and carry a charge which is being transported by said roll;

b) a cooling pipe positioned within said hollow interior of said roll body interior and extending from an end of said roll body to an end of said cooling pipe positioned at about half of the length of said roll body;

c) insulation provided within said hollow interior of said roll body, said insulation surrounding a portion of said cooling pipe with said insulation being positioned adjacent said end of said roll body and axially spaced from said end of said cooling pipe; and d) a coolant supply coupled to said cooling pipe wherein in use a temperature gradient is achieved between the furnace temperature and the coolant temperature such that said roll body will work at a temperature lower than the furnace temperature.

2. The roll of claim 1 wherein said cooling pipe is nonrotatably mounted within said roll body.

3. The roll of claim 1 wherein said roll body is supported for rotation, on at least one end, upon two rollers mounted in a common frame.

4. The roll of claim 1 further including a metal heat shield positioned over said roll body between said spaced tires.

5. A roll for a high temperature roller hearth furnace, said roll comprising:

a) a heat resistant roll body having a hollow interior;

b) a cooling pipe positioned within said hollow interior of said roll body interior and extending from an end of said roll body to an end of said cooling pipe positioned at about half of the length of said roll body;

c) insulation provided within said hollow interior of said roll body, said insulation surrounding a portion of said cooling pipe with said insulation being positioned adjacent said end of said roll body and axially spaced from said end of said cooling pipe;

d) two rollers mounted in a common frame at said end of said roll body rotatably supporting said roll body, and a third roller positioned at said end of said roll body above said roll body to prevent uplift of said roll body; and e) a cooling supply coupled to said cooling pipe wherein in use a temperature gradient is achieved between the furnace temperature and the coolant temperature such that said roll body will work at a temperature lower than the furnace temperature.

* * * * *